US008934823B1

(12) United States Patent
Pickering et al.

(10) Patent No.: US 8,934,823 B1
(45) Date of Patent: Jan. 13, 2015

(54) DONOR ROLLER FOR USE IN A FUSER ASSEMBLY

(71) Applicants: Jerry Alan Pickering, Hilton, NY (US); David Francis Cahill, Rochester, NY (US)

(72) Inventors: Jerry Alan Pickering, Hilton, NY (US); David Francis Cahill, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 14/065,543

(22) Filed: Oct. 29, 2013

(51) Int. Cl.
*G03G 15/20* (2006.01)

(52) U.S. Cl.
CPC ..... *G03G 15/206* (2013.01); *G03G 2215/2093* (2013.01); *G03G 15/2025* (2013.01)
USPC ..... 399/325

(58) Field of Classification Search
CPC ..... G03G 15/2025; G03G 2215/2061; G03G 2215/2093
USPC ..... 399/325, 324; 118/261, 262, 266
See application file for complete search history.

(56) References Cited

U.S. PATENT DOCUMENTS

| | | | | |
|---|---|---|---|---|
| 4,659,621 | A | 4/1987 | Finn et al. | 428/339 |
| 5,061,965 | A | 10/1991 | Ferguson et al. | 399/325 |
| 5,141,788 | A | 8/1992 | Badesha et al. | 428/36.8 |
| 5,166,031 | A | 11/1992 | Badesha et al. | 430/124.33 |
| 5,937,255 | A * | 8/1999 | Kagawa | 399/324 |
| 6,190,771 | B1 | 2/2001 | Chen et al. | 428/375 |
| 7,187,897 | B2 * | 3/2007 | Zess et al. | 399/325 |
| 2003/0223790 | A1 * | 12/2003 | Kawamoto et al. | 399/327 |
| 2013/0051829 | A1 * | 2/2013 | Pickering et al. | 399/67 |

* cited by examiner

*Primary Examiner* — Sophia S Chen
(74) *Attorney, Agent, or Firm* — Peyton C. Watkins

(57) ABSTRACT

A donor roller for use in a fuser assembly of an electrophotographic printing apparatus, the donor roller includes a core; a silicone cushion surrounding the core; wherein the silicone cushion includes a surface gloss greater than 5G60 and a concave shaped surface with a diameter differential of greater than 0.3 mm.

7 Claims, 2 Drawing Sheets

DONOR ROLLER FOR USE IN A FUSER ASSEMBLY

FIELD OF THE INVENTION

The present invention relates to fuser members and silicone donor rollers having a surface profile and surface gloss used as fuser members. The present invention also relates to electrostatographic imaging and recording apparatus, and to assemblies in these apparatus for fixing toner to the substrates. Furthermore, the present invention relates particularly to fuser members, and release fluid donor roller used for fuser members, in the toner fixing assemblies.

BACKGROUND OF THE INVENTION

Generally in electrostatographic reproduction, the original to be copied is rendered in the form of a latent electrostatic image on a photosensitive member. This latent image is made visible by the application of electrically charged toner.

The toner forming the image is transferred to a substrate, also referred to in the art as a "receiver", such as paper or transparent film, and fixed or fused to the substrate. Where heat softenable toners, for example, thermoplastic polymeric binders, are employed, the usual method of fixing the toner to the substrate involves applying heat to the toner once it is on the substrate surface, to soften it and then permitting or causing the toner to cool. This application of heat in the fusing process is at a preferred temperature of about 90° C.-220° C.; pressure can be employed in conjunction with the heat.

A system or assembly for providing the requisite heat and pressure is generally provided as a fusing subsystem, and customarily includes a fuser member and a support member. The various members that make up the fusing subsystem are considered to be fusing members; of these, the fuser member is the particular member that contacts the toner to be fused by the fusing subsystem. The heat energy employed in the fusing process is generally transmitted to toner on the substrate by the fuser member. Specifically, the fuser member is heated to transfer heat energy to toner situated on a surface of the substrate. The fuser member contacts this toner, and correspondingly also can contact this surface of the substrate itself. The support member contacts an opposing surface of the substrate.

Accordingly, the substrate can be situated or positioned between the fuser and support members so that these members can act together on the substrate to provide the requisite pressure in the fusing process. In cooperating, preferably the fuser and support members define a nip, or contact arc, through which the substrate passes. Preferably, the fuser and support members are in the form of fuser and pressure rollers, respectively. Yet additionally one or both of the fuser and support members have a soft layer that increases the nip to effect better transfer of heat to fuse the toner.

During the fusing process toner can be offset from the substrate to the fuser member. Toner transferred to the fuser member in turn can be passed on to other members in the electrostatographic apparatus or to subsequent substrates subjected to fusing. Toner on the fusing member therefore can interfere with the operation of the electrostatographic apparatus and with the quality of the ultimate product of the electrostatographic process. This offset toner is accordingly regarded as contamination of the fuser member, and preventing or at least minimizing this contamination is a desirable objective Release agents are frequently applied to fusing members during the fusing process, to combat toner offset. These agents usually are or include polyorgano-siloxanes, particularly polyorganosiloxane oils. The polysiloxanes have anti-adhesive properties that are favorable for protecting the surface of the fuser member, and maintaining the durability of the fuser member. Release agents are most effective when applied in a uniform, continuous layer, as can be achieved with a donor roller oiler.

A donor roller oiler includes two rollers and a metering blade, which can be a rubber, plastic, or metal blade. One roller meters the oil in conjunction with the blade, and the other transfers the oil to the fuser roller. The roller transferring the oil to the fuser, or donor roller, is usually a compliant cushioned roller. This type of oiler is common in the art, and is frequently used with fuser members having fluoroelastomer fusing surface layers.

The compliant cushioned donor roller must provide a uniform layer of release agent while preventing toner contamination on the fuser roller from collecting on the other oiler components. It is desirable that the roller have a long life and be low cost to manufacture.

According to prior art techniques the toner release agents can be applied to the fuser roller by way of a release agent donor roller which can include an EPDM (terpolymer elastomer made from ethylene, propylene and diene monomer) core with a thin sleeve of Teflon, PFA (E.I. DuPont De Nemours) which is an independent extruded thin sleeve of material which is bonded onto the core.

The use of such a sleeve is very expensive and the manufacturing of such a donor roll, is tedious and inefficient, the yield being relatively low since so many of the sleeves are damaged during manufacture. Furthermore, in a fusing assembly such as that illustrated in FIG. 1, which will be described in greater detail hereinafter, such a sleeved release agent donor roller is ineffective in that since the release agent donor roller is driven by frictional engagement with the fuser roll, the hard Teflon PFA coating has a relatively low coefficient of friction difficulties are presented in providing the necessary driving component. Additionally, unless expensive fluorosurfactants or fluorosilicones are employed, the release fluid does not wet the fluorocarbon surface and this causes non-uniform oil delivery.

Another technique has been with the use of a release agent donor roller made of a high temperature vulcanized silicone rubber material. Another development is described in U.S. Pat. No. 4,659,621 to Finn et al. wherein a release agent donor roller is described as having a conformable donor surface including the crosslinked product of at least one addition curable vinyl terminated or vinyl pendant polyorganosiloxane, a polyfunctional silicone hydride crosslinking agent crosslinking catalyst and finely divided filler. While these silicone elastomer donor rolls have been commercially successful in some commercial applications they suffer from certain difficulties in that they tend to swell by being in contact with a silicone oil release agent which migrates or is absorbed into the silicone rubber. While a small degree of swelling can be acceptable if it is uniform, failure of such rolls has been observed by excessive swelling over a period of operation wherein the release agent donor roller can actually be twice the original size. Under such circumstances, the silicone rubber release agent donor roller can no longer function in providing a uniform layer of release fluid to the fuser roll.

Another recent development is described in U.S. Pat. No. 5,061,965 to Ferguson et al. This describes the use of a release agent donor roller made of a base roller, an intermediate comfortable silicone elastomer layer, and an elastomer release layer including poly(vinylidene fluoride-hexafluoropropylene-tetrafluoroethylene) where the vinylidene fluoride is present in an amount <40 mole %, a metal oxide present in an amount sufficient to interact with polymeric release agent having functional groups to transport a sufficient amount of polymeric release agent to provide an interfacial barrier layer between the fusing surface and the toner. This release agent donor roller suffers from the polymeric release agent wetting capability between the nonfunctional PDMS release agent and the nonreactive release agent donor roller surface since the invention counts on the polymeric release agent having functional groups to react with the metal oxide which is dispersed in the fluoroelastomer layer.

A more recent development described in U.S. Pat. Nos. 5,141,788 and 5,166,031 to S. Badesha wherein a release agent donor roller including a supporting substrate having an outer layer of a surface grafted or volume grafted polyorganosiloxane formed by dehydrofluorination of the fluoroelastomer by nucleophilic dehydrofluorinating agent, followed by addition polymerization by the addition of an alkene functionalized polyorganosiloxane and a polymerization initiator. Fabricated release agent donor roller used for supplying conventional silicone oil release agent showing 4.3 million copies without failure. Although these rolls provide long life, non-oil swelling, and can be used with non-functional PDMS release agent, the manufacturing of such a release agent donor roller is tedious, inefficient, and expensive.

Another more recent development is described in U.S. Pat. No. 6,190,771 to Chen et. al. wherein a silicone donor roller is prepared that has a controlled swell. Although these rolls provide reduced impact of oil swelling and can be used with non-functional PDMS release agent, the rollers oil compatibility is reduced and thus the ability to resist toner contamination is impaired.

It would be desirable to have a simple donor roller that would effectively resist toner contamination while being resistant to the effects of oil swell. It would further be desirable that it is simple and low cost to manufacture.

SUMMARY OF THE INVENTION

According to the intents and purposes of the present invention, there is provided a donor roller for use in a fuser assembly of an electrophotographic printing apparatus, wherein the donor roller comprises a core, a silicone cushion surrounding the core, and wherein the silicone cushion includes a surface gloss greater than 5 G 60 gloss, or more preferable greater than 10 G 60 gloss, and a concave shaped surface with a diameter differential of greater than 0.3 mm, or between about 0.3 mm and 0.7 mm. In a preferred embodiment the silicone cushion includes an oil swell of less than 20%, or between about 6% and 20%. The concave shaped surface of the silicone cushion preferably includes an end portion and center portion, wherein the end portion includes substantially all of the diameter differential, and wherein the end portion is from an end of the roller extending up to 40% toward a center of the roller.

Additionally, the end portion of the donor roller can also include a first portion and a second portion, wherein the two portions equally share the diameter differential and the second portion is larger than the first portion in its axial dimension, and the second portion is between the first portion and the center portion.

DETAILED DESCRIPTION OF THE PREFERRED EMBODIMENT

Figure 1:
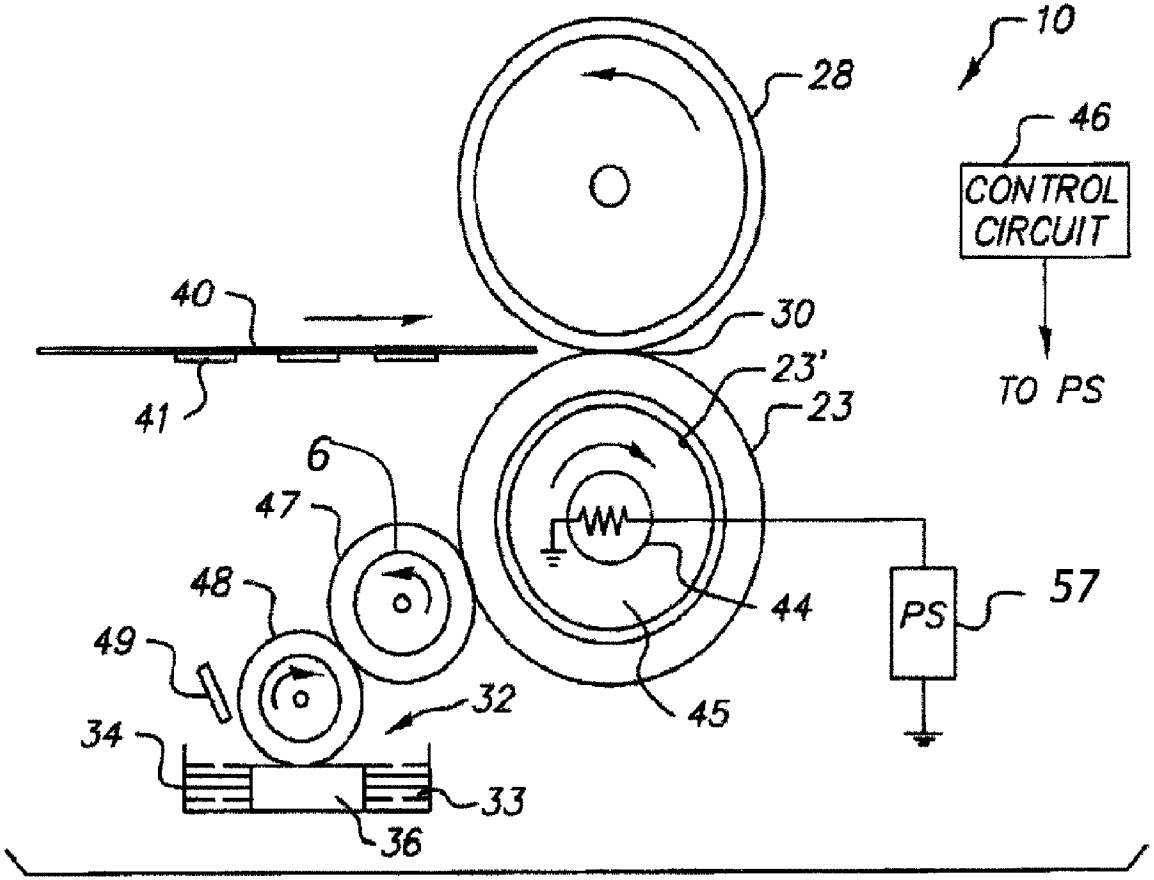
FIG. 1 is a schematic front cross-sectional view of a fuser assembly in accordance with the present invention.

Referring now to FIG. 1 a fuser assembly 10 is shown which includes a fuser roller 23 and an elastomeric pressure roller 28 which form a nip 30. A supply of polymeric release agent 33 is shown provided in a polymeric release agent reservoir 34. The fuser roller 23 can be made of an elastomer either silicone or fluoropolymer based. Particulate imaging material 41 disposed on a receiver 40 is fused into the receiver 40 at the nip 30 by the application of heat and pressure. A heating lamp 44 is connected to a power supply 57 whose current output is determined by the control circuit 46. The heating lamp 44, which is well known to those skilled in the art, is provided inside a core 45 of the fuser roller 23. Alternatively, the fuser roller 23 can be externally heated by a heated roller riding along the fuser roller 23. This external heat source can replace or merely assist the internal lamp 44. A wicking device 32, shown in the form as a wick 36, absorbs the polymeric release agent 33 and is contacted by a metering roller 48, intermediate between the fuser roller 23 and the metering roller 48 is a release agent donor roller 47. The release agent donor roller 47 delivers polymeric release agent 33 to the particulate imaging material 41 and to the receiver 40. This polymeric release agent 33 is metered by a doctor blade 49. A continuous supply of polymeric release agent 33 must be used which is approximately 1 to 20 mg per receiver 40, on which particulate imaging material 41 is fixed.

The release agent donor roller 47 according to the present invention can include a solid or hollow cylinder core 6 about 5 millimeters to 30 millimeters in diameter and a conformable donor surface coating from 2 about to 8 millimeters in thickness. The surface coating can be even thicker if desired to adjust for certain nip characteristics. Typically the rolls are from about 12 to 30 inches in length.

The release agent donor roller 47 is typically in the configuration of an economical, highly reliable, long life cylindrical roller which is conformable with the fuser roller 23 and provides uniform delivery of a sufficient amount of polymeric release agent 33 to provide an interfacial barrier layer between the fusing surface and the toner. By selecting the surface features of the release agent donor roller 47 according to the present invention, the positive properties of the individual components are accentuated while the negative properties are minimized. Thus, as previously described while traditional silicone elastomer release agent donor rollers 47 on their own tend to swell resulting in early failure, by providing the specific profile described, the early failure from swelling due to polymeric release agent 33 is corrected. Furthermore, with the high gloss of the release agent donor roller 47, contamination of metering roller 48 and doctor blade 49 are prevented, permitting release agent donor roller 47 to deliver a substantially uniform quantity of release agent 33 across the surface of the fuser roller 23.

The present invention includes the release agent donor roller 47 having a single cushion and a core. The core can be metal, composite, or high temperature plastic but preferably includes a hollow stainless steel or aluminum metal cylinder. The cushion is preferably a silicone elastomer. The silicone can be a condensation curable silicone or addition cure silicone. The silicone elastomer can contain fillers such as fume silica, crystalline silica, or metal oxides including iron oxide, alumina, titanium dioxide and the like. The cushion is adhered to the core by a primer layer. The cushion also includes the surface layer.

The cushion surface preferably has a high gloss. The surface gloss is preferably achieved by molding the cushion in a tube mold having a smooth surface such that the molded cushion conforms to and duplicates the smooth surface. The mold can be reused or sacrificial. The mold surface can be prepared by polishing to a high gloss, electroplating or electro-etching to a high gloss, application of a release coating, or deposition of a smooth coating by vapor or plasma or sputtering. Typically a metal tube is mechanically polished and then electroplated with nickel or chrome. Alternatively a smooth sacrificial polymer film can be used.

The cushion surface gloss is preferably greater than 5 G60 gloss units when measured using a Gartner Gloss meter. More preferably the surface gloss is greater than 10 G60 gloss, and most preferably the gloss is greater than 15 G60 gloss. For a curved roller surface, the meter is placed against the roller and measurements are taken while slightly tilting the meter axially around the roller. The peak gloss, or highest gloss measured, is taken as the surface gloss. Alternatively a fixture can be prepared to align the gloss meter to the roller surface.

The high gloss is characteristic of a surface that is smooth on a very small scale and prevents attachment of toner contamination from the fuser roller and transfer into the oiler. While not completely understood, it is thought that the molded surface, cast against the interior of the mold, is inherently rich in the silicone matrix as the filler particles are excluded from the surface. This smooth, as-cast silicone surface resists picking up contamination from the fuser and thus keeps the oiler system clean.

The release agent donor roller 47 is used in conjunction with silicone release fluids. These release fluids are typically polyalkylsiloxanes, but can contain release additives such as surfactants or functional release agents. Polyalkylsiloxanes are preferably polydimethylsiloxane having low volatility and viscosity between about 100 cp and 10000 cp at operating temperature. For most donor roller oiler systems the viscosity is preferably between about 200 cp and 1000 cp at operating temperature, and more preferably between about 250 cp and 500 cp at operating temperature. Low volatility can be defined as a weight loss of less than 1% when a small volume is held at operating temperature for 24 hours, where the operating temperature is the typical fuser roller operating temperature. A typical test would place about 2 grams in a circular aluminum weighing pan having a diameter of about 2 inches.

The cushion of the present invention swells in the release fluid. The swell of the cushion should not be too great as this can cause the cushion to lose mechanical properties too quickly, or excessively change shape and fail to apply release fluid uniformly. The cushion does have some swell in the release fluid, if there is too little swell of the cushion in the release fluid, the contamination from the fuser is more likely to transfer to the donor roller surface and contaminate the oiler. The swell of the cushion is preferably less than about 25% or about 20%, more preferably between about 6% and 20%, or between about 8% and 20%, or more preferably between about 10% and about 15%. Swell of the cushion can be measured by submerging the donor roller cushion in the release fluid at the operating temperature of the donor roller. The change in the donor roller cushion thickness over time is the swell of the cushion. Since a silicone cushion can continue to change due to degradation, the time is limited to 15 days.

Figure 2:
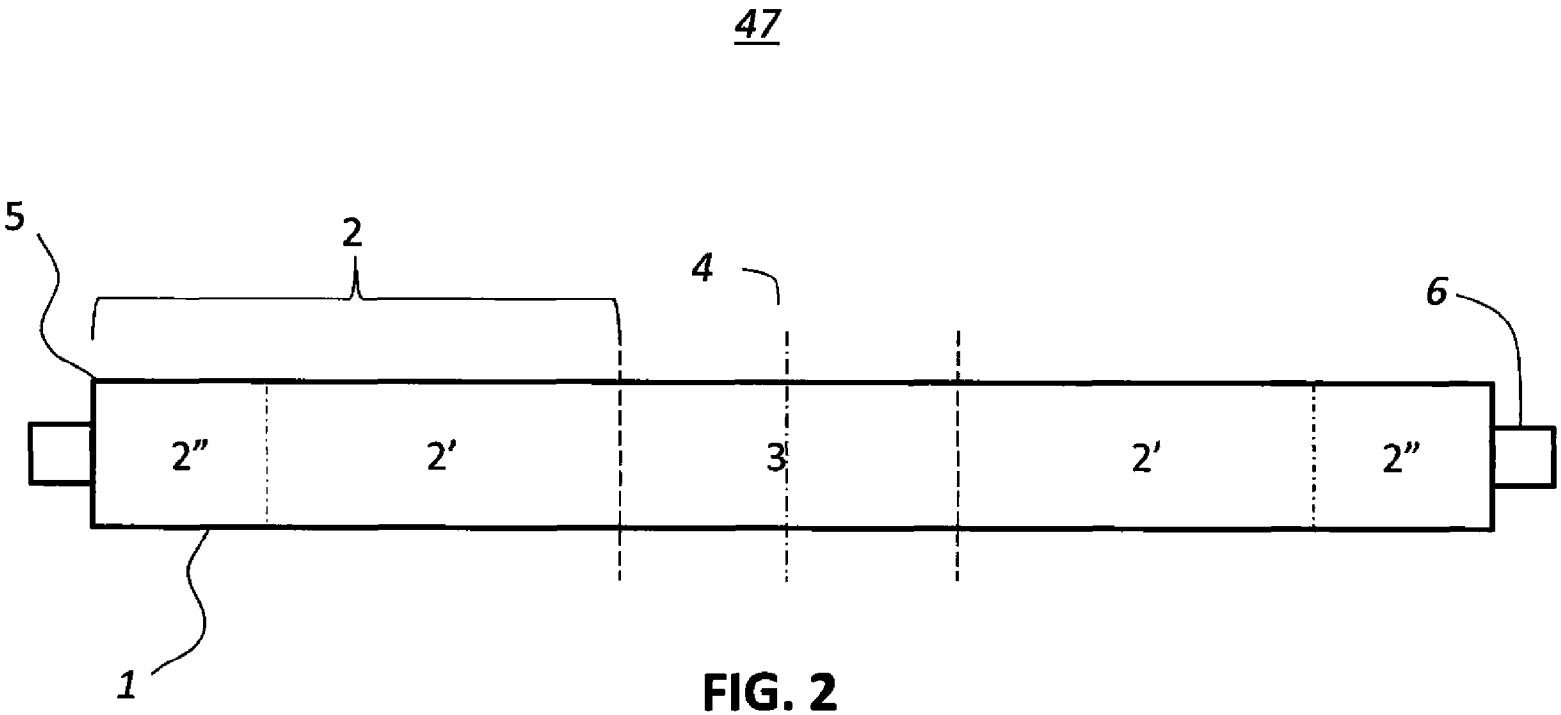
FIG. 2 is a cross-sectional view of the release agent donor roller of FIG. 1.

The release agent donor roller 47 has a concave silicone surface where the center of the release agent donor roller 47 has a smaller diameter than the ends. Referring now to FIG. 2 the release agent donor roller 47 has a silicone cushion 1 including a concave shaped surface which includes an end portion 2, and a center portion 3. Where the end portion 2 is up to 40% of the axial length and the center portion 3 is at least 20% of the axial length. The end portion 2 includes substantially all of the diameter differential between the ends and the center. In this manner, the center portion 3 is substantially free of diameter differential, and has a relatively constant diameter, and the end portion 2 is larger in diameter than the center portion 3, and includes nearly all of the diameter differential. In a preferred embodiment, the end portion 2 is further divided into two portions, a first portion 2" and a second portion 2', wherein the second portion 2' is adjacent to the center portion 3, and the first portion 2" is at the ends of the release agent donor roller 47. The diameter of the release agent donor roller 47 increases from the second portion 2' to the first portion 2", where the first and second portions have the same amount of diameter differential, and the axial length of the second portion 2' is larger than the first portion 2". Because the second portion 2' encompasses a longer axial length than the first portion 2", the slope of the diameter of the second portion 2' is less than the slope of the diameter of the first portion 2". In this manner, the roller becomes larger in diameter more rapidly as one approaches the ends of the release agent donor roller 47.

The particular shape of the concavity, having a relatively flat center portion and an increasing diameter at the roller ends, is designed to counter the unusual profile that a silicone roller develops over time when used as a donor roller in a fusing or fixing subsystem. The concave shaped surface should have a diameter differential between a center 4 and an end 5 of greater than 0.3 mm, preferable between 0.3 mm and 0.7 mm. In a silicone donor roller that does not have a profile, the center of the roller swells much more than the very end regions of the roller forming a barrel shape. This is unexpected as the ends of the fuser are usually at a higher temperature and there is often an excess of release fluid due to the lack of contact with the printed media, both of which might be expected to increase the amount of swell. While not completely understood, it is thought that this is due the more rapid rate at which new fluid is delivered to the center region. While the donor roller applies silicone release fluids uniformly to the fuser roller surface, the media which passes through the fuser roller 23 is most commonly in a center region, and less commonly in the end regions. This is because narrower widths of media which can be employed do not reach the end regions but only contact the center region, while wider width medias contact both the center and end regions. The media removes the release fluid at a rapid rate, and fluid must be replenished from the fluid delivery system. At the ends of the fuser, the release fluid is re-circulated back to the oiler, so fresh fluid is delivered at a reduced rate. Since the swell of a silicone rubber matrix is caused by trace amounts of oligomers in the silicone fluid, the oligomer concentration at the ends is depleted and the swell is reduced.

Comparative Example

Silicone release agent donor rollers 47 having a ground surface with a G60 gloss of less than 1 and a flat profile where the average end diameter was substantially the same as the center was run to failure in a Nexpress production digital printer. The failure was due to lack of oiling the ends of the release agent donor roller 47 due to poor contact. The release agent donor rollers 47 had swollen non-uniformly into a barrel shape such that the ends were an average of between about 0.3 mm to 0.4 mm smaller than the center.

Example

The release agent donor roller 47 having a radius of about 33.9 mm diameter with a silicone cushion thickness of about 5.85 mm and a durometer of about 30 to 35 shore A, where the center diameter was 0.38 mm smaller than the average end diameter was run in a Nexpress production digital printer for 300K. The release agent donor roller 47 was then measured on a laser fixture for diameter and it was found to be swollen, however the center diameter was only 0.11 mm smaller than the average of the ends, such that the roller diameter was relatively uniform.

It is at first surprising that rollers with approximately the same differential diameter between the center and ends behave differently, where the rollers with the ends smaller than the center, i.e. barrel shape, fail to operate correctly yet rollers where the ends are larger than the center, i.e. a flare or crown shape, provide suitable performance. It can be understood that since the changes that cause failure in the prior art to form a barrel shape cause a large portion of the roller to act as a spring and prevent contact at the smaller ends. However, in the present invention the flair of the ends includes a much smaller spring and good contact can be made across the roller length.

The present invention has been described in detail with particular reference to certain preferred embodiments thereof, but it will be understood that variations and modifications can be effected within the spirit and scope of the invention.

PARTS LIST

1 silicone cushion
2 end portion
2" first portion
2' second portion
3 center portion
4 center
5 end
6 core
10 fuser assembly
23 fuser roller
28 elastomeric pressure roller
30 nip
32 wicking device
33 supply of polymeric release agent
34 polymeric release agent reservoir
36 wick
40 receiver
41 imaging material
44 heating lamp
45 core
46 control circuit
47 release agent donor roller
48 metering roller
49 doctor blade

The invention claimed is:

1. A donor roller for use in a fuser assembly of an electrophotographic printing apparatus, the donor roller comprising:

a) a core; and b) a silicone cushion surrounding the core; wherein the silicone cushion includes a surface gloss greater than 5 G60 gloss units and a concave shaped surface with a diameter differential of greater than 0.3 mm.

2. The donor roller as in claim 1, wherein the silicone cushion includes an oil swell of less than 20%.

3. The donor roller as in claim 1, wherein the diameter differential is between 0.3 mm and 0.7 mm.

4. The donor roller as in claim 1, wherein the concave shaped surface of the silicone cushion includes an end portion and center portion, and the end portion includes substantially all of the diameter differential.

5. The donor roller as in claim 4, wherein the end portion is from an end of the roller extending up to 40% toward a center of the roller.

6. The donor roller as in claim 4, wherein the end portion includes a first portion and a second portion, and the first and second portions equally share the diameter differential and the second portion is larger than the first portion in its axial dimension, and the second portion is between the first portion and the center portion.

7. The donor roller as in claim 1, wherein the surface gloss is greater than 10 G60 gloss units.

* * * * *